US005320393A

United States Patent [19]

Cortinas

[11] Patent Number: 5,320,393

[45] Date of Patent: Jun. 14, 1994

[54] REFUSE COLLECTING DEVICE

[75] Inventor: Alfredo I. Cortinas, Buenos Aires, Argentina

[73] Assignee: Panagra Incorporated, Calabasas, Calif.

[21] Appl. No.: 815,318

[22] Filed: Dec. 27, 1991

[51] Int. Cl.[5] ..... A01K 29/00

[52] U.S. Cl. ..... 294/1.4; 15/257.6

[58] Field of Search ..... 294/1.3–1.5, 294/50.8, 50.9, 55; 15/104.8, 257.1, 257.6

[56] References Cited

U.S. PATENT DOCUMENTS

| | | | |
|---|---|---|---|
| 3,757,737 | 9/1973 | Drum et al. | 294/1.4 |
| 3,910,619 | 10/1975 | Schmieler | 294/1.4 |
| 4,042,269 | 8/1977 | Skermetta | 15/257.6 X |
| 4,148,513 | 4/1979 | Gagné | 294/1.4 |
| 4,200,321 | 4/1980 | Warkentin | 294/1.4 |
| 4,360,229 | 11/1982 | Kinney | 294/1.4 |
| 4,641,873 | 2/1987 | Nurnberger | 294/1.4 |
| 4,986,587 | 1/1991 | Lozano | 294/1.4 |

*Primary Examiner*—Dean J. Kramer

[57] ABSTRACT

An improved device for collecting refuse by using a fixed holding member and moveable expander to releasably hold a bag open by virtue of tension forces exerted across the mouth of the bag. A paddle, spring-loaded to a closed position across the mouth, can also be hingedly rotated to an open position and held in the open position by a trigger. When an animal owner desires to have the paddle scoop refuse into the bag, he can manually move the trigger. This action releases the spring-biased paddle which then rotates under spring bias, scooping refuse before it, to the closed position. The scooped refuse, because of the propelling movement of the paddle's rotation, is thrown on into the bag. A moving mechanism, which is also spring-biased, can both cock the paddle in the open position and also release the bag. As the moving mechanism pulls the paddle toward the open position, a latch pin connected through a cable to the paddle is caught and held by the trigger. The moving mechanism can then return to its normal resting position under the action of spring bias, while the paddle remains in the caught, cocked position. When it is desired to release the paddle, the trigger is manually depressed and the paddle returns under spring-bias to its normally closed position.

3 Claims, 2 Drawing Sheets

REFUSE COLLECTING DEVICE

BACKGROUND OF THE INVENTION

This invention relates to an improved disposal device for animal droppings and more specifically to a device for the sanitary release of animal droppings scooped into a bag.

Many municipalities have laws and ordinances requiring animal owners to remove the feces left by their animals from public and private property. In carrying out this task, an animal owner is concerned about how he or she can accomplish this task in a sanitary manner.

There are numerous devices which can be used to collect animal droppings and place them in a bag. U.S. Pat. No. 4,210,351 to Orofino and U.S. Pat. No. 4,225,174 to Hennessy et al., for instance, illustrate pickup devices having bags which can be placed over the refuse and the refuse collected by pinching together other members of the devices to enclose the refuse within the respective bags. Since these bags open from the bottom and are closed with a pincher movement, these devices become awkward to use when more than one body of droppings needs to be picked up. Any refuse already in the bag will fall out when the bag is opened a second time, thus requiring a combined pile of refuse to be picked up in a second gathering.

U.S. Pat. No. 3,757,737 to Drum et al. avoids the problem of having the bag opening from the bottom by placing the bag so that feces can be scooped sideways into the bag. But this device has no mechanism to remove the bag without an animal owner touching the bag since the bag is held by hooks attached to a handle of the device.

In addition to overcoming the problem of having the bag oriented so as to scoop refuse into the bag, it is highly desirable for an animal owner to be able to cock a paddle in an open position for subsequent closing at his or her convenience. Then when refuse is found in an awkward, or barely reachable position, such as under bushes or beneath parked cars or trucks, an animal owner can usually position the device easily, and correctly oriented, to pick up the refuse. Then by just releasing a trigger, the refuse can be scooped into the bag. Later, the animal owner should be able to dispose of the bag and its contents in a sanitary way without touching the bag.

SUMMARY OF INVENTION

The present invention relates to an improved device for collecting refuse by releasably holding a bag open by using a fixed holding member and moveable expander. The holding member and moveable expander are inserted into the mouth of a bag to tightly expand the mouth and hold the bag in place on the device by virtue of tension forces exerted across the mouth. The bag can easily be oriented into a position where refuse can be scooped sideways into the bag. Later when desired, the bag can be freed from the device by moving the moveable expander closer to the fixed member to decrease the distance between holding members and release the tension that is holding the bag on the device.

A paddle, spring-loaded to a closed position across the mouth of the bag and shaped to provide a closure for the bag, can also be hingedly rotated to an open position and held in the open position by a trigger. When an animal owner desires to have the paddle scoop refuse into the bag, he can manually move the trigger which releases the spring-biased paddle. The paddle then rotates under spring-bias, scooping refuse before it, to the closed position over the mouth of the bag. The scooped refuse, because of the propelling movement of the paddle's rotation, is thrown on into the bag where it will not escape due to the paddles.

A moving mechanism, which is also spring-biased, can both cock the paddle in the open position and also release the bag. As the moving mechanism pulls the paddle toward the open position, a latch pin connected through a cable to the paddle is caught and held by the trigger. The moving mechanism can then return to its normal resting position under the action of spring-bias, while the paddle remains in the caught, cocked position. When it is desired to release the paddle, the trigger is manually depressed and the paddle returns under spring-bias to its normally closed position.

BRIEF DESCRIPTION OF THE DRAWINGS

In order that the invention may be clearly understood and readily carried into effect, a preferred specific embodiment of the invention will now be described, by way of example only, with reference to the accompanying drawings wherein.

DESCRIPTION OF A PREFERRED EMBODIMENT

Figure 1:
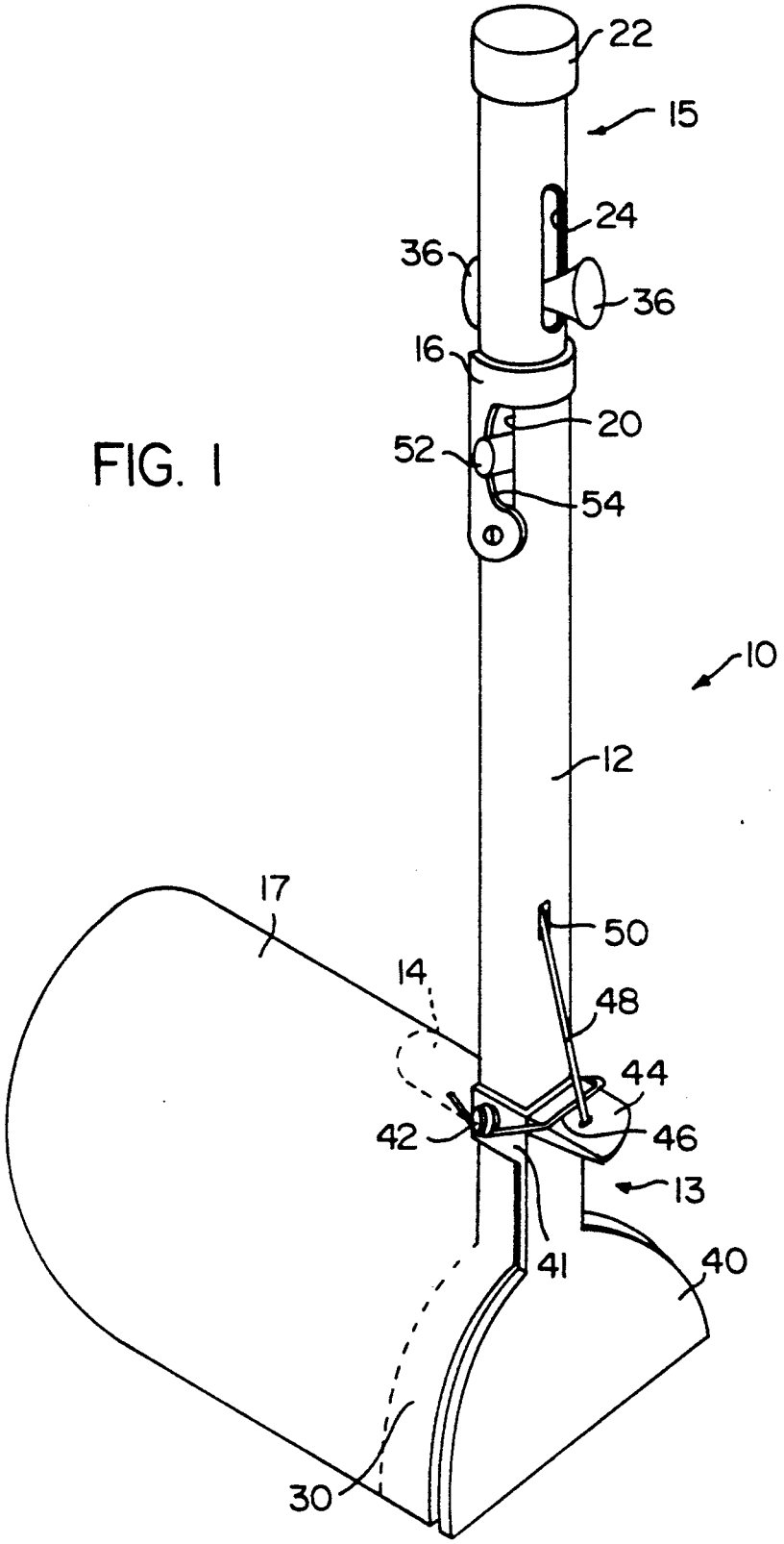
FIG. 1 is a perspective view of the present invention showing an elongated, tubular handle.
Figure 2:
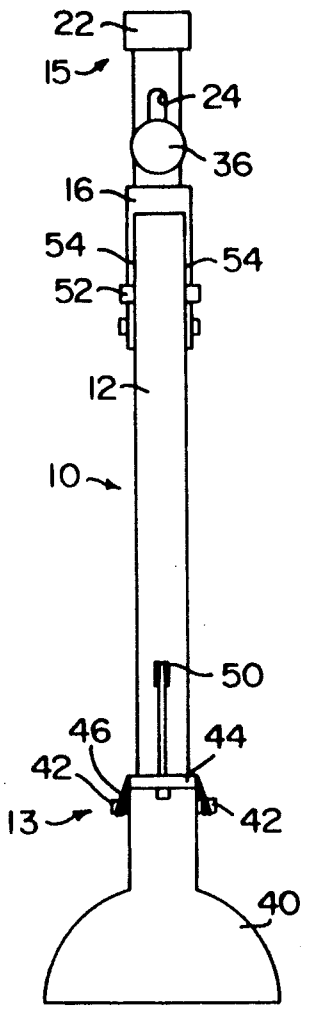
FIG. 2 is a front elevational view of the invention shown in FIG. 1.
Figure 3:
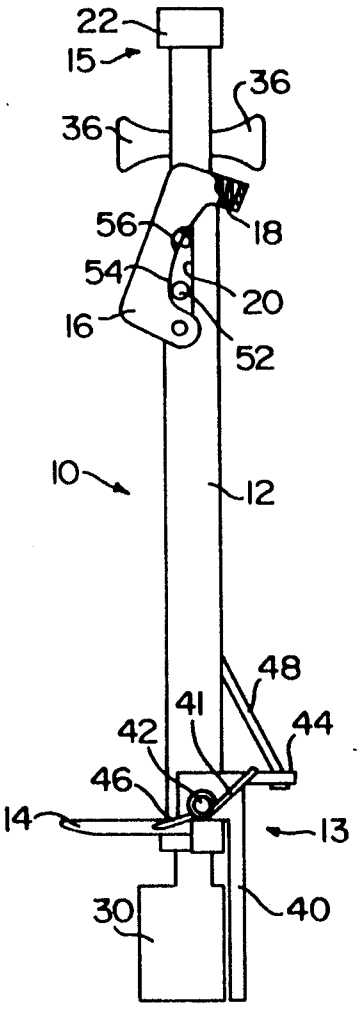
FIG. 3 is a side elevational view of the invention shown in FIG. 2.

A preferred embodiment of the refuse collecting device 10 is shown in FIG. 1 wherein the refuse collecting device has an elongate handle 12 having a first end 13 and a second end 15. A fixed holding means 14, which in the preferred embodiment is a platform fixedly connected to the elongate handle, extends on one side of the handle proximate the first end 13 and is used for insertion into the mouth of a bag 17. Proximate the second end 15 of elongate handle 12, a trigger 16 is pivotally mounted to the handle and is spring-loaded by trigger spring 18 to have the portion furthest removed from the pivotal mount rotate away from the handle as shown in FIG. 3. Elongate handle 12 also has first slots 20 extending along the longitudinal axis and on opposite sides of the handle. Slots 20 are positioned so as to underlie trigger 16 and provide openings for part of a trigger mechanism. At the second end 15 of handle 12, a cap 22 is removably placed over the handle to hold the internal structure of the handle in place within the handle. Between slots 20 and cap 22, second slots 24 extend along the longitudinal axis and on opposite sides of the handle 12 to provide a movement space for cocking the device.

Figure 4:
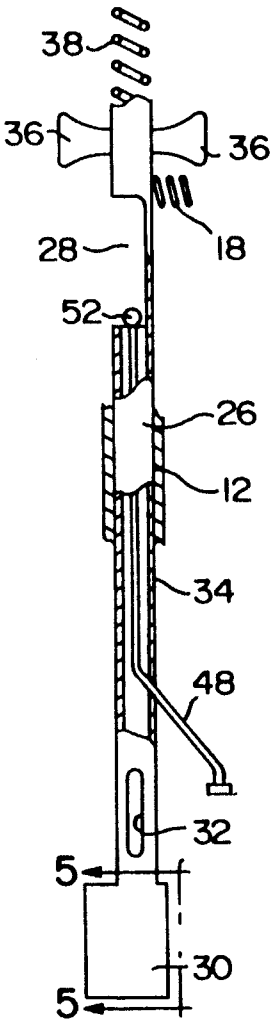
FIG. 4 is an elevational view of the internal structure of the tubular handle shown in FIGS. 1, 2, and 3 with parts broken away.
Figure 5:
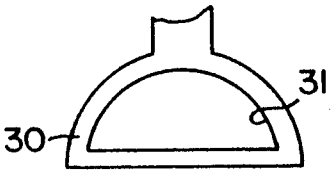
FIG. 5 is a front elevational view taken along the line 5—5 in FIG. 4.

Internal to tubular handle 12, a slidable tube 26, as best seen in FIG. 4, is sized smaller in diameter than the inside diameter of handle 12 so as to freely move along the longitudinal axis within the handle. Tube 26 slidably moves to hold and release bag 17, and also to cock trigger 16. Tube 26 has a cutout 28 cut in the walls of the tube in a position adjacent to first slots 20 which is used as part of the trigger mechanism. At the other end of tube 26, an expanding means 30, which in the preferred embodiment is a stirrup curved around an opening 31 in the stirrup as best seen in FIG. 5, is fixedly connected to the end of tube 26 in a manner such that a perpendicular to the longitudinal axis of tube 26 can pass through opening 31 without intersecting the stirrup. Expanding means 30 is used to open the mouth of bag 17 and to place tension across the mouth of the bag whenever the expanding means 30 and holding means 14 are inserted into the mouth and the expanding means is moved away from the holding means.

Cutout 28 and third slots 32 extend longitudinally along tube 26 on opposite sides of the tube to provide an elongate space for tube 26 to slide longitudinally even though a rod may extend across slidable tube 26 through third slots 32. A fourth slot 34 is cut in the wall of tube 26 to provide an exit opening for a cable to be led from the interior to the exterior of tube 26. Between cutout 28 and the end of tube 26 adjacent second end 15, knobs 36 can be threadably received by tube 26 to provide a grip for sliding tube 26 along the longitudinal axis within elongate handle 12.

Whenever tube 26 is slidably received in elongate handle 12, spring 38 is placed between tube 26 and cap 22 to bias tube 26 to extend outward from first end 13 of the handle. Knobs 36 are inserted through second slots 24 and are threadably secured to tube 26 to provide convenient grips for overcoming the bias of spring 38 as tube 26 is moved. Expanding means 30 which is connected to tube 26 at the end extending from first end 13 is thus biased to extend away from the first end by action of spring 38 pushing tube 26 away from second end 15.

A paddle 40 has extensions 41 sized to extend from the paddle on either side of handle 12 with each extension 41 having an axle-receiving bore therethrough. Paddle 40 is pivotally mounted on elongate handle 12 by having axle 42 extend through slots 32 in slidable tube 26, through the axle-receiving bores in each extension 41, and then extending beyond each extension 41 on opposite sides of the handle. Paddle 40 also has a flange 44 extending generally perpendicular to the paddle as shown in FIG. 3 to control movement of the paddle. A bifurcated coiled spring 46 has the non-coiled center portion led across the top portion of the flange, which is the side closest to the second end 15, has the pair of coils placed at opposite ends of axle 42, and has the free ends of the spring led to opposite sides of the holding means 14 where the free ends are forced by the coils against the side of the holding means facing first end 15. Spring 46 in the above configuration biases paddle 40 to rotate angularly toward opening 31 in the stirrup of expanding means 30.

A latch cable 48 is fixedly attached to flange 44 to rotate paddle 40 angularly away from opening 31 in the stirrup of expanding means 30. Latch cable 48 is led from flange 44 where it is secured, through opening 50 in handle 12, and then through fourth slot 34 into the interior of sliding tube 26. Latch cable 48 is then led toward second end 15 where it is fixedly attached to latch pin 52 so that the latch cable and the latch pin form a rotating means in the preferred embodiment. Movement of latch pin 52 toward the second end 15 thus rotates paddle 40 away from expanding means 30. Latch pin 52 extends across slidable tube 26 within cutout 28, extends through first slots 20 of handle 12, and extends beyond handle 12 so that it can be caught outside the handle. The portion of cutout 28 that is closest to first end 13 can engage latch pin 52 and pull the latch pin toward second end 15 whenever tube 26 is pulled toward the second end.

Trigger 16 has a cam wall 54 on each side of handle 12 which cam walls are biased by spring 18 to press against latch pin 52. Each cam wall 54 also has a notch 56 cut in the cam wall to retain latch pin 52 if the latch pin enters the notch. Whenever tube 26 is pulled toward second end 15, latch pin 52 rides against cam wall 54. When tube 26 is released, latch pin 52 slides against cam wall 54 until the latch pin falls into notch 56 where it is caught. Whenever the latch pin is caught by notch 56, paddle 40 will have been rotated to an "open position" and will be held in this position by the caught latch pin. Slidable tube 26 will return to its extended position by reason of the biasing action of spring 38. Whenever trigger 16 is depressed toward handle 12, latch pin 52 will be removed from notch 56 and the paddle will move under the biasing action of spring 46 to a "closed position" beside expanding means 30 and lying across the opening of the bag and effectively closing the bag.

In operation, holding means 14 and expanding means 30 are inserted into the mouth of bag 17 to hold the bag open. Spring 38 biases the expanding means 30 to extend from first end 13 and place tension upon the mouth of the bag 17 because of the separating movement between holding means 14 and expanding means 30. The tension holds bag 17 in place upon elongate handle 12. Whenever it is desired to cock the paddle in the "open position", knobs 36 are pulled toward second end 15. This pulls latch pin 52 along cam wall 54 and rotates paddle 40 away from expanding means 30. When knobs 36 are released, latch pin 52 is caught in notch 56 with spring 18 biasing trigger 16 to press against latch pin 52. Whenever latch pin 52 is caught in notch 56, paddle 40 is in the "open position".

Depressing trigger 16 against the bias of trigger spring 18, releases latch pin 52. Paddle 40 then rotates toward expanding means 30 to the "closed position" scooping any refuse that might be in front of the paddle into bag 17 through the opening 31 in expanding means 30.

When it is desired to dispose of bag 17 containing refuse, pulling knobs 36 toward the second end 15 moves expanding means 30 toward holding means 14. This movement releases the tension holding bag 17 to handle 12. Bag 17 is then free to drop away from expanding means 30 and holding means 14.

While the fundamental novel features of the invention have been shown and described, it should be understood that various substitutions, modifications and variations may be made by those skilled in the art without departing from the spirit or scope of the invention. Accordingly, all such modifications or variations are included in the scope of the invention as defined by the following claims.

What is claimed is:

1. A device for collecting refuse through the mouth of a bag, the device comprising:

an elongate handle having a longitudinal axis and a first and second end;

a bag expanding means connected to the handle;

a bag holding means connected to the handle;

a means for moving the bag expanding means between a position away from said bag holding means to a first position where the mouth of the bag is held open between the bag expanding means and the bag holding means and a position where the bag expanding means is closer to the bag holding means to allow the bag to fall free of the bag holding means;

paddle means hingedly connected to the handle and being rotatable from a closed position where the paddle means effectively closes the mouth of an open bag to an open position further removed angularly from the expanding means than the closed position, said paddle means serving to move refuse into said bag when being rotated from an open to a closed position;

an elongate rotating means, connected to the paddle at one end and releasably held by the handle at the other end, for rotating the paddle, the rotating means being caught by a trigger as the moving means moves toward the second position;

said trigger connected to the handle: and said trigger being actuated manually to release the rotating means after the rotating means has been caught.

2. The device according to claim 1 wherein the expanding means is a member curved around an opening and positioned in such a manner that a perpendicular from the longitudinal axis passes through the opening without intersecting the curved member.

3. The device according to claim 2 wherein the curved member is a stirrup.

* * * * *